US006312321B1

(12) United States Patent
Fukushima et al.

(10) Patent No.: US 6,312,321 B1
(45) Date of Patent: Nov. 6, 2001

(54) POLISHING APPARATUS

(75) Inventors: Dai Fukushima, Fujisawa; Hiroyuki Yano, Yokohama; Gaku Minamihaba, Kawasaki, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/494,656

(22) Filed: Jan. 31, 2000

(30) Foreign Application Priority Data

Jan. 26, 2000 (JP) ..... 12-016951

(51) Int. Cl.[7] ..... B24B 1/00
(52) U.S. Cl. ..... 451/285; 451/60
(58) Field of Search ..... 451/60, 63, 285, 451/287

(56) References Cited

U.S. PATENT DOCUMENTS 5,709,588 * 1/1998 Muroyama ..... 451/41
5,730,642 * 3/1998 Sandhu et al. ..... 451/41 X
5,807,165 * 9/1998 Uzoh et al. ..... 451/60 X

OTHER PUBLICATIONS

Co–pending U.S. Application No. 09/306,758: Attorney Docket No.: 04329.2039–00000, Title: Polishing Cloth And Method Of Manufacturing Semiconductor Device Using The Same, Inventors: Hiroyuki Yano, et al., U.S. Filing Date: May 7, 1999.

* cited by examiner

*Primary Examiner*—Joseph J. Hail, III
*Assistant Examiner*—Anthony Ojini
(74) *Attorney, Agent, or Firm*—Finnegan, Henderson, Farabow, Garrett & Dunner, L.L.P.

(57) ABSTRACT

The CMP apparatus including a polishing pad having functional groups charged at an opposite polarity to that of the abrasives in the slurry, on its surface is used, so as to eliminate unnecessary Cu film (Cu wiring) and TaN film (barrier metal film) present outside the damascene wiring, by polishing.

8 Claims, 4 Drawing Sheets

POLISHING APPARATUS

BACKGROUND OF THE INVENTION

Recently, in the field of manufacturing semiconductors, various fine processing techniques have been and are presently developed as the size of semiconductor elements reduces and the integration degree of semiconductor elements increases. Of these techniques, the CMP (chemical mechanical polishing) technique is one of the essential elements for making a buried structure such as a buried metal wiring or a buried element separation.

In the case where a surface to be polished, which is a surface having an irregularity (recesses and projections), is smoothed by the CMP, the polishing rate is influenced by the surface state of the polishing pad of the CMP apparatus employed. Conventionally, the state of the surface of the polishing pad is designed such that abrasives within the slurry are sufficiently held on the surface of the polishing pad.

BRIEF SUMMARY OF THE INVENTION

The object of the invention is to provide a polishing apparatus capable of preventing the deterioration of a polishing property which is caused by the state of the polishing pad. In order to achieve the above-described object, there is provided, according to the present invention, a polishing apparatus comprising: a polishing pad having a plurality of functional groups on its surface, and a slurry supply means for supplying a slurry containing abrasives, onto the surface of the polishing pad.

With the above-described structure, by selecting appropriate functional groups for the abrasives in the slurry, the deterioration of the polishing property, which is caused depending on the state of the polishing pad, can be prevented. For example, in the case where the abrasives in the slurry are positively charged, a functional group which is charged negatively is selected. In this manner, the abrasives are adsorbed electrically to the functional groups, and thus the power of the polishing pad which holds abrasives is increased. As a result, the decrease in the polishing rate or the occurrence of erosion can be suppressed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

In conventional CMP apparatus, a hydrophobic material is used for the pad, and therefore the polishing pad and slurry are not very well familiarized, thus weakening the physical absorption force between the polishing pad the abrasives. As a result, there will be an increased number of abrasives which are not held onto the polishing pad, thus decreasing the number of effective grains for polishing. Consequently, a sufficient polishing rate cannot be easily obtained.

Meanwhile, the increase in the number of such floating abrasives makes it difficult to suppress erosion. Especially, in the present damascene wiring process, it is one of the most important objects to be achieved, to suppress the erosion to a low level, for suppressing the increase in wiring resistance or the dispersion of the resistance, which is necessary for facilitate the process of multi-layered wiring. Therefore, the increase in the number of floating abrasives is a critical problem.

Now, embodiments of the present invention which can solve the above-described problems, will be described with reference to accompanying drawings.

(First Embodiment)

FIG. 1 is a set of cross sectional views showing steps of the method of forming a Cu damascene wiring according to the present invention.

Figure 1A:
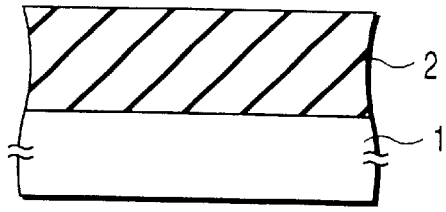
FIGS. 1A to 1E are cross sectional views showing steps in a method of forming a Cu damascene wiring according to the first embodiment of the present invention.

First, as shown in FIG. 1A, an interlayer insulating film 2 is deposited on an Si substrate 1 in which elements (not shown) are formed integrated.

Figure 1B:
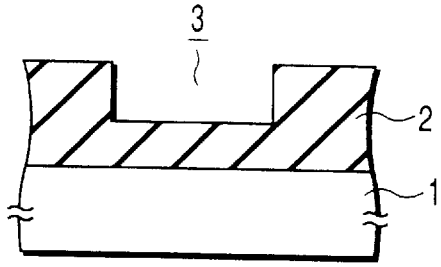

Next, as shown in FIG. 1B, a wiring groove 3 having a depth of 400 nm is made in a surface of the interlayer insulating film 2 by means of photolithography and etching (for example, RIE: reactive ion etching).

Figure 1C:
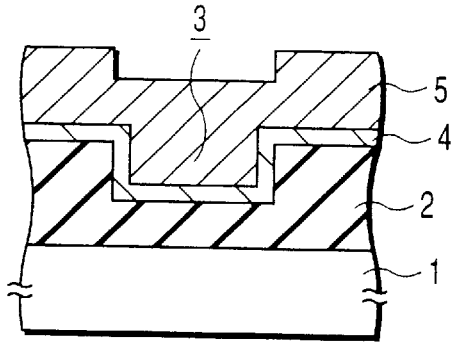

Next, as shown in FIG. 1C, a TaN film 4 having a thickness of 20 nm, serving as a barrier metal, is deposited so as to cover the entire surface (including the bottom surface and side surfaces) of the wiring groove 3, and subsequently a Cu film 5 having a thickness of 800 nm, serving as wiring, is deposited on the entire surface so as to bury the wiring groove 3 by means of a sputtering method.

Figure 1D:
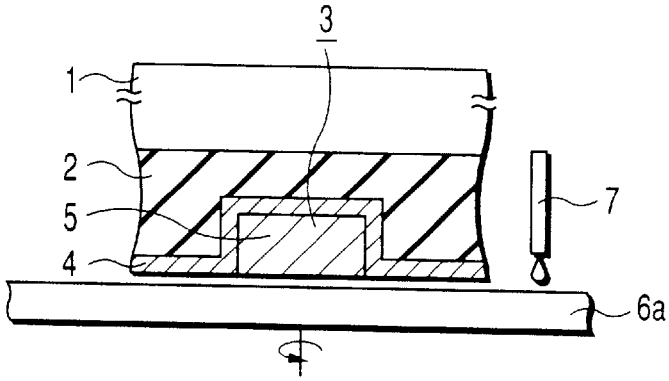

Next, as shown in FIG. 1D, with use of a CMP apparatus equipped with a rotatable polishing pad 6*a* having anion-based functional groups on its surface, and a slurry supply tube 7 for supplying ammon persulfate having a pH of 8.5, quinaldic acid and alumina-based slurry onto a surface to be polished, unnecessary Cu film 5 which is present outside the wiring groove 3 is removed (the first step polish). The other conditions for the CMP are as follows. That is, the TR (top ring)/TT (turntable) ratio is 60/100, and the polishing time is 2 minutes.

Figure 2:
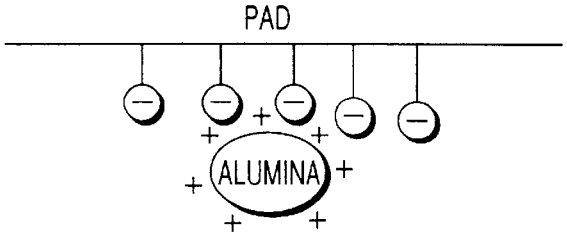
FIG. 2 is an illustration showing the surface state of the polishing pad employed in the first embodiment, within a slurry containing alumina.

In this embodiment, as shown in FIG. 2, alumina (abrasives) within the slurry is positively charged, whereas anion-based functional groups on the pad surface are negatively charged. Therefore, the alumina in the slurry is adsorbed to the anion-based functional group on the pad surface by an electrical attraction force.

Figure 3A:
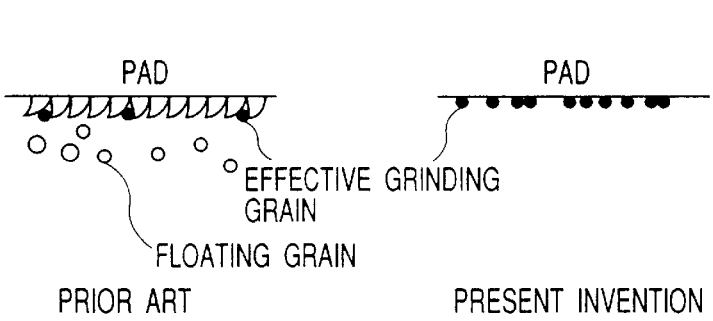
FIGS. 3A and 3B are diagrams designed to illustrate the effect of the present invention regarding the polishing rate.
Figure 3B:
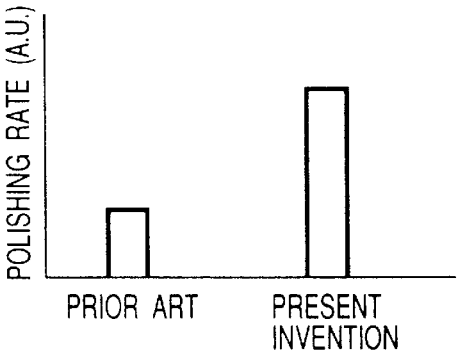

As a result, the holding power of the polishing pad 6*a* with respect to alumina (abrasives) becomes higher, and therefore as presented in FIG. 3, the number of alumina grains (abrasives) effective for the polishing and the polishing rate will be increased as compared to the conventional technique.

Those alumina grains (floating grains) which are not held onto the polishing pad 6*a* remain in the recesses of the Cu film 5, thus increasing the polishing rate for the recesses. In this manner, the elimination of stepped portions cannot be achieved. Therefore, the suppression of the erosion cannot be achieved.

Figure 4A:
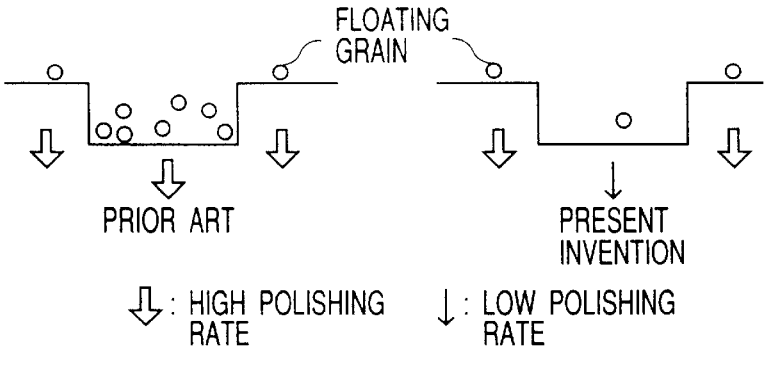
FIGS. 4A and 4B are diagrams designed to illustrate the effect of the present invention regarding the erosion.
Figure 4B:
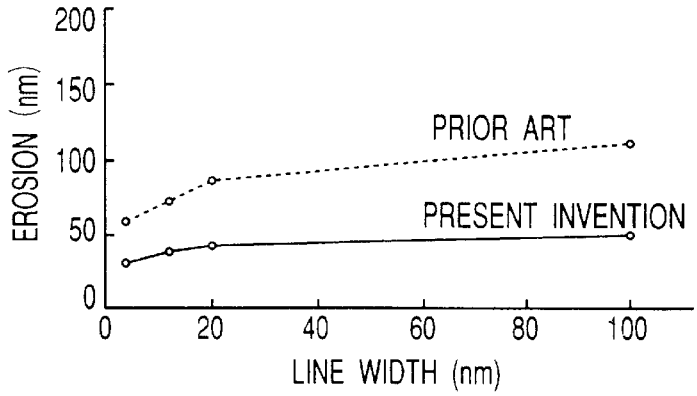

However, with the present invention, as can be seen in FIG. 4, the number of abrasives effective for the polishing is increased and the number of the floating grains is decreased as compared to the conventional technique, and therefore the erosion can be suppressed. Such an effect can be expected even in the case where anion-based functional groups and cation-based functional groups are mixedly present on the surface of the pad; however in order to obtain a sufficient effect, it is preferable that the ratio between the anion-based functional group/the cation-based functional group on the pad surface should be high.

Figure 1E:
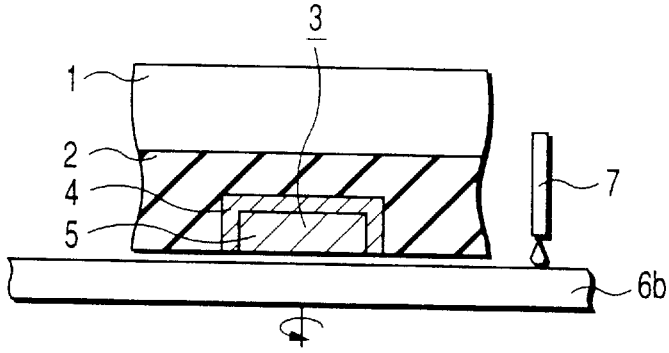

Lastly, as shown in FIG. 1E, by means of a CMP method which employs, in place of the polishing pad 6*a*, a polishing pad 6*b* having cation-based functional groups on its surface, ethylene diamine having a pH of 10.5 and silica-based slurry, unnecessary TaN film 4 which is present outside the wiring groove 3 and unnecessary Cu film 5 on the wiring groove 3 are removed (the second step polish), and thus a Cu damascene wiring is completed. At the same time, the interlayer insulating film 2 is polished as well due to over-polishing.

The other conditions for the CMP are as follows. That is, the TR (top ring)/TT (turntable) ratio is 50/50, and the polishing time is 1 minute.

Figure 5:
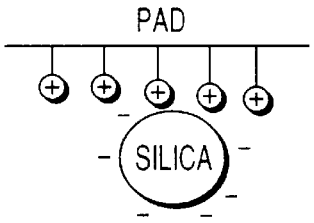
FIG. 5 is an illustration showing the surface state of the polishing pad employed in the first embodiment, within a slurry containing silica.

Here, as shown in FIG. 5, silica (abrasives) within the slurry is negatively charged, whereas cation-based functional groups on the pad surface are positively charged. Therefore, the silica in the slurry is adsorbed to the cation-based functional group on the pad surface by an electrical attraction force.

As a result, similar to the case of the first step polish, the holding power of the polishing pad 6*b* with respect to the abrasives becomes higher, and therefore the increase in the polishing rate and the suppression of the erosion can be achieved.

It should be noted that the second step polishing more easily increases the erosion caused by floating grains as compared to the first step polish, for the following reason.

Figure 6:
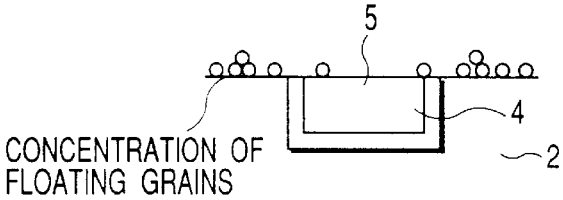
FIG. 6 is a cross sectional diagram designed to illustrate the problem in the second step polishing.

That is, in the second step polishing, the TaN film 4, Cu film 5 and interlayer insulating film 2 are subjects to be polished. In the case where a plurality of different films to be polished are present as this, floating grains are concentrated above a particular film to be polished (interlayer insulating film 2) as can be seen in FIG. 6. That results in that the degree of concentration of abrasives differs from one subject to be polished to another. As a result, it becomes impossible to achieve the selection ratio of the expected polishing rate (the control of the selection ratio) due to a difference in the polishing rate created for various subjects to be polished. Consequently, the erosion caused by the floating grains can easily be increased.

In this embodiment, a case of a so-called single damascene wiring is explained; however the present invention can be applied to a dual damascene wiring in which a plug and wiring are formed at the same time. Further, the above embodiment is described in connection with the case where Cu is used as its wiring material; however the present invention can be applied also to the case where a wiring material of, for example, Al is employed.

(Second Embodiment)

In this embodiment, the conditioning of the polishing pad which utilizes the functional groups on the pad surface will be described.

In general, when polishing (CMP) proceeds, the configuration of the pad surface varies, and the holding power of the polishing pad with respect to abrasives is decreased. Consequently, as the polishing proceeds, the polishing rate lowers.

Figure 7:
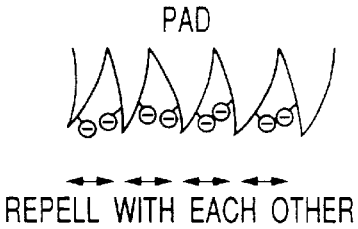
FIG. 7 is an illustration showing the surface state of the polishing pad employed in the second embodiment, within a slurry.

However, with use of a polishing pad having substantially only anion-based functional groups on the pad surface, or a polishing pad having substantially only cation-based functional groups, in other words, with use of a polishing pad having only functional groups of the same polarity, these functional groups electrically repel with each other as can be seen in FIG. 7, and therefore it becomes possible to maintain the configuration of the pad surface.

Figure 8:
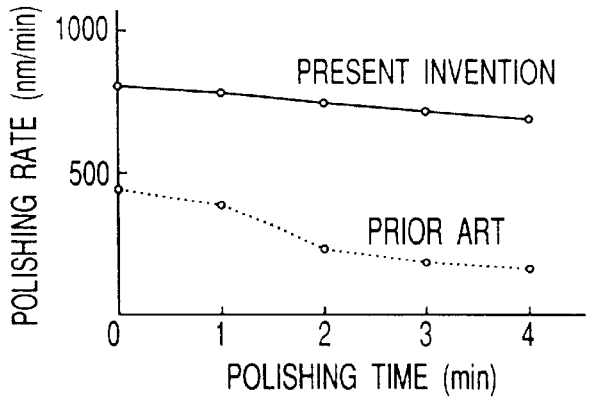
FIG. 8 is a diagram designed to illustrate the effect of the present invention regarding the time dependency of the polishing rate.

More specifically, the polishing pad having functional groups of the same polarity, is capable of performing a conditioning by itself. As a result, according to the present invention, a higher polishing rate can be maintained for a long time as compared to the conventional technique as can be seen in FIG. 8. With this achievement, it is no longer necessary to perform the second step polish, but it is possible to finish a process with only the first step polish. Here, naturally, scratches are not created.

Further, with use of an alkali liquid agent (pH: 12) for the conditioning performed between wafers, shavings and abrasives adsorbed on the polishing pad are charged with the same polarity as that of the functional groups. As a result, the shavings and abrasives adsorbed on the polishing pad repel with the functional groups, and therefore the shavings and abrasives can be more effectively eliminated.

(Third Embodiment)

In this embodiment, another erosion suppression method which utilizes functional groups on the pad surface will be described.

If the polishing pad is hardened, the erosion can be suppressed, but at the same time, the number of scratches created increases. On the contrary, if the polishing pad is softened, the scratch can be suppressed, but the erosion increases.

In this embodiment, for the purpose of suppressing erosion and scratches at the same time, a polishing pad having anion-based functional groups and cation-based functional group on the pad surface is used.

Figure 9:
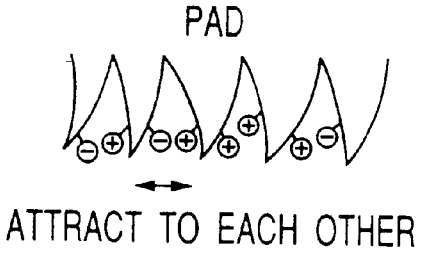
FIG. 9 is an illustration showing the surface state of the polishing pad employed in the third embodiment, within a slurry.

With use of such a polishing pad, an electrical attraction force acts between the anion-based and cation-based functional groups as can be seen in FIG. 9. As a result, the polishing cloth of the pad surface intertwines to become a polishing pad having an appropriate hardness, that is, a polishing pad having such a hardness degree that can suppress the erosion and scratches at the same time, can be obtained. Further, as the polishing cloth intertwines, the thickness of the polishing cloth becomes thin.

Figure 10:
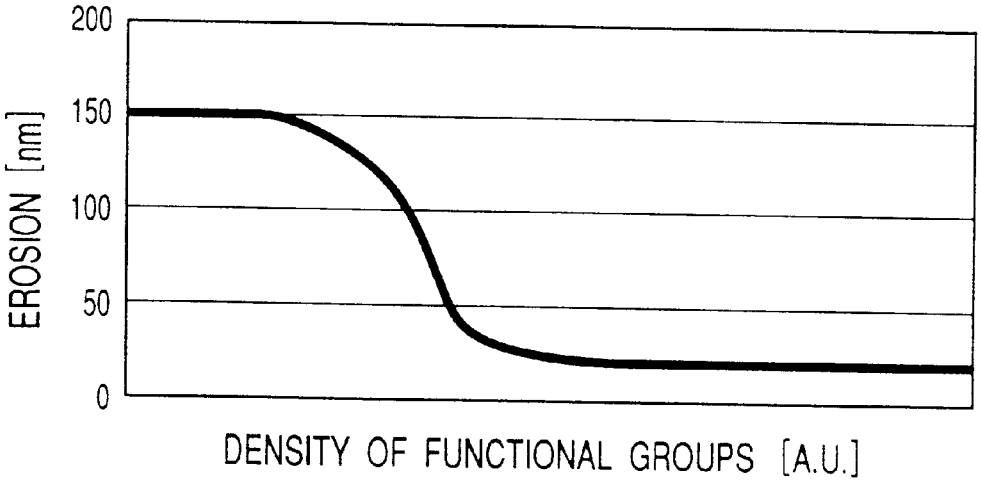
FIG. 10 is a diagram showing the dependency of the erosion on the density of functional groups.

So far, the present invention has been described in connection with the above-described embodiments; however the invention is not limited to these embodiments. For example, in the above embodiment, a case where the erosion is suppressed by using appropriate functional groups, is discussed. However, even with a polishing pad which uses the same functional groups, the erosion can be sufficiently suppressed by increasing the density of the functional groups on the pad surface as can be seen in FIG. 10. It is considered this is because by increasing the density of the functional groups, there would be no substantial floating abrasives present within the slurry.

Further, as the functional groups, ampholytic (bipolar) type or non-ionic type, or type which contains at least one of these can be used in addition to the anion- or cation-based type.

Here, examples of the anion-based functional group are those which contains at least one kind of functional group of, for example, sulfonic acid type, carbonic acid type, sulfuric acid ester type and phosphoric acid ester type. Examples of the cation-based functional group are those which contains at least one kind of functional group of, for example, amine salt type and quaternary ammonium salt type. Examples of the ampholytic (bipolar) functional group are those which contains at least one kind of functional group of, for example, carboxybetaine type and glycine type. Examples of the non-ionic functional group are those which contains at least one kind of functional group of, for example, ether type, ester type and alkanol amide type.

Further, typical examples of the slurry which can be used in the present invention are of aluminum oxide, silica, bengala, seria, carbon and manganese dioxide, and materials containing a mixture of a plurality of substances selected from these. Meanwhile, examples of the material of the surface to be polished to be brought into contact with the polishing pad, are of aluminum, copper, tungsten, titanium, niobium, tantalum, silver, vanadium, ruthenium, platinum, oxides of these, nitrides of these, borides of these, alloys of these, and a plurality of surfaces made of materials selected from these.

The above-described embodiments are described in connection with the case where the CMP apparatus of the present invention is applied to the process of forming a damascene wiring (buried metal wiring); however the present invention can be used in the process of forming some other buried structure such as a buried element separation structure in STI (shallow trench isolation).

Additional advantages and modifications will readily occur to those skilled in the art. Therefore, the invention in its broader aspects is not limited to the specific details and representative embodiments shown in described herein. Accordingly, various modifications may be made without departing from the spirit or scope of the general inventive concept as defined by the appended claims and their equivalents.

What is claimed is:

1. A polishing apparatus comprising:

a polishing pad having a plurality of functional groups on its surface; and a slurry supply means for supplying a slurry containing abrasives, onto the surface of the polishing pad.

2. A polishing apparatus according to claim 1, wherein a density of said functional groups on the surface of the polishing pad is selected such that floating abrasives vanish substantially in the slurry.

3. A polishing apparatus according to claim 1, wherein said plurality of functional groups are charged at an opposite polarity to that of the abrasives.

4. A polishing apparatus according to claim 1, wherein said plurality of functional groups consists of a plurality of functional groups negatively charged, and a plurality of functional groups positively charged.

5. A polishing apparatus according to claim 1, wherein said plurality of functional groups contain at least one type of functional groups selected from the group consisting of anion-based type, cation-based type, ampholytic (bipolar) type, and non-ionic type.

6. A polishing apparatus according to claim 5, wherein the anion-based functional groups contain at least one kind of functional group of a sulfonic acid type, carbonic acid type, sulfuric acid ester type and phosphoric acid ester type, the cation-based functional groups contain at least one kind of functional group of an amine salt type and quaternary ammonium salt type, the ampholytic (bipolar) functional groups contain at least one kind of functional group of a carboxybetaine type and glycine type, and the non-ionic functional groups contain at least one kind of functional group of an ether type, ester type and alkanol amide type.

7. A polishing apparatus according to claim 1, wherein the abrasives comprise at least one material chosen from aluminum oxide, silica, bengala, seria, carbon and maganese dioxide.

8. A polishing apparatus according to claim 1, wherein the surface to be polished and brought into contact with the polishing pad is at least one metal chosen from aluminum, copper, tungsten, titanium, niobium, tantalum, silver, vanadium, ruthenium, and platinum, and oxides, nitrides, borides, and alloys thereof.

* * * * *